US007743911B2

(12) United States Patent
Kudrus

(10) Patent No.: US 7,743,911 B2
(45) Date of Patent: Jun. 29, 2010

(54) DRAWING MACHINE AND METHOD OF DRAWING A WORKPIECE

(75) Inventor: Heiner Kudrus, Eupen (BE)

(73) Assignee: SMS Schumag GmbH & Co. KG, Aachen (DE)

( * ) Notice: Subject to any disclaimer, the term of this patent is extended or adjusted under 35 U.S.C. 154(b) by 0 days.

(21) Appl. No.: 10/594,709

(22) PCT Filed: Mar. 29, 2005

(86) PCT No.: PCT/DE2005/000560

§ 371 (c)(1),
(2), (4) Date: Dec. 6, 2006

(87) PCT Pub. No.: WO2005/092533

PCT Pub. Date: Oct. 6, 2005

(65) Prior Publication Data

US 2007/0267276 A1 Nov. 22, 2007

(30) Foreign Application Priority Data

Mar. 28, 2004 (DE) ..... 10 2004 015 513
May 7, 2004 (DE) ..... 10 2004 023 237

(51) Int. Cl.
*B65G 37/00* (2006.01)

(52) U.S. Cl. ..... 198/626.1; 198/604; 198/620; 198/867.06; 198/867.08

(58) Field of Classification Search ..... 198/626.1; 226/170, 172
See application file for complete search history.

(56) References Cited

U.S. PATENT DOCUMENTS 2,742,144 A 4/1956 Meyerbach
2,797,798 A 7/1957 Hallden
3,144,949 A * 8/1964 Haugwitz ..... 414/431
3,761,003 A * 9/1973 Sieurin ..... 226/172
3,945,547 A 3/1976 Ledebur
4,360,054 A * 11/1982 Perrella et al. ..... 164/269
5,094,340 A * 3/1992 Avakov ..... 198/626.1
5,775,417 A * 7/1998 Council ..... 166/77.3
5,931,337 A 8/1999 Ando et al.
2001/0006153 A1 7/2001 Merrell
2003/0150770 A1 8/2003 Campbell et al.
2004/0011111 A1 1/2004 Klingen et al.

FOREIGN PATENT DOCUMENTS

DE 2448157 4/1976
DE 2629512 12/1977
DE 2942110 4/1981

(Continued)

OTHER PUBLICATIONS

International Search Report.

(Continued)

*Primary Examiner*—Gene Crawford
*Assistant Examiner*—Kavel P Singh
(74) *Attorney, Agent, or Firm*—Collard & Roe, P.C.

(57) ABSTRACT

In order to develop drawing machines for drawing a linear workpiece, the invention proposes a drawing machine with a caterpillar conveyor for drawing a linear workpiece through a drawing die, in which the caterpillar conveyor comprises a frame configured to be symmetrical with respect to the drawing plane.

31 Claims, 3 Drawing Sheets

FOREIGN PATENT DOCUMENTS

| | | |
|---|---|---|
| EP | 0433767 | 6/1991 |
| EP | 1 005 928 | 6/2000 |
| EP | 1005828 | 6/2000 |
| GB | 1450136 | 9/1976 |
| NL | 1012599 | 3/2000 |
| WO | WO 00/17481 | 3/2000 |

OTHER PUBLICATIONS

International Search Report.

* cited by examiner

DRAWING MACHINE AND METHOD OF DRAWING A WORKPIECE

CROSS REFERENCE TO RELATED APPLICATIONS

Applicant claims priority under 35 U.S.C. §119 of German Application No. 10 2004 015 513.5 FILED Mar. 28, 2004 and German Application No. 10 2004 023 237.7 filed May 7, 2004. Applicant also claims priority under 35 U.S.C. §365 of PCT/DE2004/000560 filed Mar. 29, 2005. The international application under PCT article 21(2) was not published in English.

The invention relates, on the one hand, to a drawing machine with a caterpillar conveyor for drawing a linear workpiece through a drawing die in which said caterpillar conveyor comprises a first chain carrier on which there are more specifically disposed first chain wheels for guiding a first tool chain and a second chain carrier on which there are more specifically disposed second chain wheels for guiding a second tool chain, said first tool chain and said second tool chain forming a drawing plane in which the workpiece to be drawn is moved, and the chain carriers being mounted so as to be relatively displaceable in a frame that absorbs press-on forces between the tool chains. On the other hand, the invention relates to a method of drawing a linear workpiece through a drawing die, by which the workpiece is conveyed by means of a first and a second tool chain of a caterpillar conveyor, said first tool chain being held by a first chain carrier and said second tool chain being held by a second chain carrier that are relatively displaceable for applying press-on forces and said first and said second tool chain forming a drawing plane in which the workpiece to be drawn is being moved.

Such type drawing machines and methods are known from prior art, so for example from DE 29 42 110 A1, which discloses a caterpillar conveyor having a carrying run with first clamping tools and a lower run with second clamping tools that are confronting each other and form a conveying path. The first clamping tools and the second clamping tools cooperate hereby in such a manner that they are capable of translationally moving an elongate item along said conveying path. For this purpose, said carrying run and said lower run are linked together through a parallelogram-type bearing arrangement that they are even capable of clamping and conveying items of different thicknesses. In order to be capable of applying the press-on forces needed for clamping and conveying the items between carrying run, lower run and items, the parallelogram-type bearing arrangement comprises two frame halves, one frame half being disposed on the left side and the other frame half on the right side of the clamping tools. Carrying run and lower run are joined together through the frame halves. The press-on forces this arrangement is capable of applying are largely insufficient to draw a workpiece through a drawing die and to deform it thereby.

In an alternative construction of a caterpillar conveyor as it is known for example from U.S. Pat. No. 2,742,144, applying sufficient press-on forces between a carrying run, a lower run and a workpiece to be drawn is solved by having both the carrying run and the lower run arranged in a substantially C-shaped frame, the press-on forces needed to draw the workpiece to be drawn being absorbed by the C-shaped frame. Similar arrangements are known for example from DE 26 29 512, U.S. Pat. No. 2,797,798 and U.S. Pat. No. 3,945,547 in which the chain wheels or chain carriers are also relatively displaceable in order to thus apply the necessary press-on forces. The advantage of such an arrangement is, inter alia, that works can be readily performed at the carrying run and at the lower run since the C-shaped frame is only arranged on one side of a conveying path. Chains on which conveying tools are disposed are very easily accessible for example so that they can be replaced in an accordingly advantageous manner. The drawback of such an arrangement however is that a relatively strong frame must be used in order for the workpiece to be gripped evenly and for a good drawing result to be ensured.

Another solution, which is not generic, is found in the document DE 24 48 157 which discloses a drawing machine in which the two chain carriers are carried by a symmetric frame through springs and limit stops. Both chain carriers are freely displaceable relative to this frame against the force of the springs until they abut on certain limit stops and can be caused to move toward each other by hydraulic cylinders disposed on the side of the chain carriers for applying the necessary press-on forces.

The printed document EP 0 433 767 A discloses a drawing machine in which an upper drawing chain and a lower drawing chain form a common drawing plane in which a workpiece to be drawn is moved. Both the upper drawing chain and the lower drawing chain lie in a common drawing plane and are driven by chain wheels. To allow for adjusting the drawing chains with respect to the workpiece to be drawn, the drawing device is provided with means for adjusting the distance between the drawing chains. These means for adjusting the distance are located laterally for both drawing chains, on one side of the common drawing planes, and are part of the drawing machine frame since the adjusting means absorb press-on forces that need to be applied in order to draw a workpiece in the region of the drawing chains. This asymmetry causes a torque to act on the adjusting means so that this drawing device is also limited with respect to the application of press-on forces onto the workpiece to be drawn.

In the printed document US 2004/0011111 A1 there is shown a drawing machine with a frame for drawing a strand that is configured in a C shape and is further strutted many times both in the transverse and the longitudinal direction. Thanks particularly to these transverse and longitudinal struts, the frame is very resistant to warping. The frame is configured to be asymmetric and accommodates drawing slides rather than drawing chains driven by means of chain wheels for transporting the strand.

Another chain drawing machine that serves as a drive unit for shaping or drawing rods or tubes is described in EP 1 005 928 A2. Again, opposite chain wheels drive a first drawing chain and a second drawing chain which together form one drawing plane. To facilitate threading a workpiece into and out of the drawing machine, a plurality of hydraulic pistons are provided behind a guide ledge in the region of one of the two drawing chains, said guide ledge being configured to be elastically deformable so that the forces applied may be transmitted to the drawing chain. The chosen simple structure of the chain drawing machines dispenses with the need for having to equip each drawing chain with its own piston and cylinder unit. The hydraulic pistons provided here also form part of a frame of the chain drawing machine since the press-on forces that are applied in order to clamp the workpiece are at least partially introduced via the hydraulic pistons. Since hydraulic pistons are only provided in the region of a drawing chain, the frame has an asymmetric structure.

It is the object of the invention to further develop known drawing machines in such a manner that the drawing result is improved using a relatively complex frame or to use a less complex, and as a result thereof, lower cost frame to achieve the same drawing result as before.

The object of the invention is solved on the one side by a drawing machine having a caterpillar conveyor for drawing a linear workpiece through a drawing die in which said caterpillar conveyor comprises a first chain carrier and a second chain carrier, the first tool chain and the second tool chain forming a drawing plane in which the workpiece to be drawn is caused to move and the chain carriers being relatively displaceable in a frame absorbing press-on forces between the tool chains, and which is characterized by the fact that a first frame half is disposed on a first side of the drawing plane and a second frame half on a second side of the drawing plane, and the first frame half and the second frame half are configured to be symmetrical in the region opposing the press-on forces.

None of the drawing machines described in prior art has a frame consisting of two symmetrically configured frame halves. It is precisely this symmetry however that offers major advantages over the prior art drawing machines since it makes it possible to absorb much higher forces or allows a much more compact construction of the drawing machine with the forces remaining the same.

Even the drawing machine shown in the printed document NL 1 012 599 T2 does not have a frame with two symmetrically configured frame halves. This drawing machine also comprises first and second drawing chains confronting each other, forming a drawing plane and being carried in the frame of the drawing machine. Devices in which the respective drawing chains are carried are relatively adjustable by means of pressure cylinders. The pressure cylinders are disposed on either side of the drawing plane in a generally asymmetrical arrangement and are thus capable of moving the corresponding drawing chains in many different positions relative to each other. Since the pressure cylinders also transmit the cylinder forces, in particular the press-on forces, in this case, thus performing a carrying function in the sense of the frame of the present invention, the drawing machine of NL 1 012 599 C2 is not a drawing machine with two symmetrically configured frame halves in which the press-on forces ideally cancel each other.

By selecting symmetrically configured frame halves, the press-on forces needed for drawing the workpiece are substantially equally distributed onto the two frame halves so that the frame as a whole is more homogeneous and, as a result thereof, better loaded so that it can also be of a more compact construction than hitherto usual. It is understood that the frame may also be configured to be symmetrical for the rest, this further equalizing the inner force distribution. On the other side, smaller divergences from symmetry such as thickness fluctuations or variations in the weld seams can be tolerated if they lie within the frame of tolerances of the overall arrangement.

The term "frame" hereby refers to an arrangement which carries the two chain carriers, meaning that positions these in space in the desired manner, against the force of gravity. The frame may preferably be an inherently rigid arrangement standing on a base or the floor. On the other side, the frame may also undertake its carrying function indirectly, such as via springs or damper arrangements or through walls carrying the frame. It is further understood that the frame needs not be completely made from one piece nor directly constitute one integral piece. Instead, the frame may also comprise a plurality of components that are attached separately and are for example standing on a floor and are joined together through the floor to form altogether an overall frame.

Preferably, first chain wheels for guiding a first tool chain are disposed on the first chain carrier and second chain wheels for guiding a second tool chain are disposed on the second chain carrier. Such an arrangement makes it possible to readily displace the tool chains in the desired manner without tension.

Depending on the concrete implementation variant, both chain carriers may for example be displaceable with respect to the frame. For this purpose, appropriate devices such as hydraulic cylinders or lever arrangements may for example be provided between the frame and the two chain carriers. On the other side, it may be sufficient to only have one of the chain carriers be displaceable with respect to the frame while the other chain carrier keeps its position with respect to the frame. In both cases, the chain carriers are displaced relative to each other since it is of no importance whether both or only one of the chain carriers is displaced as long as they are displaced differently with respect to the frame, this resulting in a relative movement of the two chain carriers. At need, it should be thereby taken into consideration that a drawing die or other devices are carried on the frame and that a relative movement with respect to the frame also entails a relative movement with respect to these devices. Insofar, it should be checked whether a relative movement between the chain carriers, caused by the displacement of only one chain carrier, will not cause the drawing path to be displaced, which would be of disadvantage with respect to these devices.

On the other side, the object of the invention is solved by a method for drawing a linear workpiece through a drawing die, by which the workpiece is conveyed by means of a first and a second tool chain of a caterpillar conveyer, the first tool chain being held by a first chain carrier and the second tool chain by a second chain carrier, said chain carriers or the chain wheels being relatively displaceable and said first and said second tool chain forming a drawing plane in which the workpiece is moved, the press-on forces needed for drawing the workpiece being opposed symmetrically by a frame with respect to the drawing plane.

Since the press-on forces of the frame are opposed symmetrically with respect to the drawing plane, the frame can be ideally stressed to its material yield point without the symmetry of the frame changing substantially. This makes it possible, inter alia, to apply the press-on forces as far as possible symmetrically onto the workpiece to be drawn even if the frame is displaced or stretched under the action of forces, this substantially improving the drawing result. This more specifically applies to drawing machines onto which considerable press-on forces need to be applied as they particularly occur on drawing machines by means of which metallic workpieces are to be deformed.

A particularly preferred implementation variant provides for means for neutralizing press-on forces within the frame so that first press-on forces, which are applied to a first press-on plane side and second press-on forces, which are applied to a second press-on plane side, are neutralizing each other within the frame. Thanks to such type means, the press-on forces can substantially neutralize each other to advantage within the frame so that the press-on forces will not be transmitted from the frame to other regions of the present drawing machine. As a result, the stress on these other regions is relieved, or these regions are not stressed by the press-on forces, so that they may be of a more delicate construction.

In order to further improve the neutralization of the press-on forces within the frame, it is advantageous if means for neutralizing press-on forces with respect to a drawing plane and/or with respect to a press-on plane are configured to be symmetrical.

As used herein, the term "press-on plane" is understood to refer to the plane that extends substantially perpendicular to the actual drawing plane.

In order to uniformly neutralize the press-on forces within the frame, it is advantageous if the means for neutralizing press-on forces are arranged both on the first and on the second frame half.

For even distribution of the press-on forces, it is conducive, as an alternative or in addition thereto, if the means for neutralizing press-on forces are disposed in a tensile region of the frame halves. In the tensile region of the frame halves, the first and second press-on forces can almost completely neutralize each other so that forces relative thereto will not leave the instant frame and thus not be transferred to other component groups of the actual drawing machine. As a result, this allows for a much more compact and, as a result thereof, lower cost construction of the actual drawing machine.

Due to the advantages mentioned, the features with regards to the means for neutralizing press-on forces are advantageous, even without the other features of the invention, so that they are also inventive.

Symmetry of the occurring forces is particularly readily achieved if the drawing machine comprises a force splitter by means of which the press-on forces applied for drawing the workpiece in the drawing plane are symmetrically distributed on either side of the drawing plane. In the present case, the force splitter makes it possible to symmetrically introduce the press-on forces into the existing frame of the caterpillar conveyor so that corresponding counter-forces symmetrically oppose the press-on forces in the frame. It is of note here that such a press-on force splitter is also advantageous without the other features of the invention, especially in conjunction with drawing chains, chain wheels, chain carriers and/or press-on beams for freely pressing on the chains the spaced-apart relationship of which can be varied.

In order for differences with regards to the occurring press-on forces to be advantageously accommodated without further regulation devices, it is advantageous to have the force splitter disposed the drawing plane. As a result, the force splitter can also be substantially symmetrically crossing in the frame so that, through the thus disposed force splitter, occurring press-on forces can be introduced particularly evenly and, as a result thereof, also advantageously into the frame.

In order to be capable of readily adjusting the present drawing machine, and more specifically the present caterpillar conveyor, to workpieces of different sizes, it is advantageous, independently of the other features of the present invention, that the caterpillar conveyor comprises a gantry that carries adjusting means for at least one of the two chain carriers, or that comprises first adjusting means for the first chain carrier and second adjusting means for the second chain carrier, said adjusting means or the first and the second adjusting means being substantially disposed in the drawing plane. In this manner, the number of adjusting means remains minimal, without the symmetry of the force distribution with respect to the drawing plane being disturbed, which can obviate the need for complex and difficult to control adjusting mechanisms for equalizing the pressures in the cylinders or the volume flows into and out of the cylinders.

The first adjusting means as well as the second adjusting means have particularly advantageous effects if both the first chain carrier and the second chain carrier provided are displaceable with respect to the frame. It is understood that it is also possible to only provide for adjusting means for one of the two chain carriers, depending on whether the first chain carrier or the second chain carrier is displaceably disposed in the frame and whether the respective chain carrier corresponding to the displaceable chain carrier is stationary fixed in the frame.

Advantageously, the adjusting means for the first chain carrier and the second chain carrier are devised to be identical or symmetrical with respect to a plane intersecting the drawing plane in the drawing path so that the two chain carriers will be displaced identically under the action of the same press-on force or the same press-on pressure. This makes it possible to readily ensure that the drawing path, meaning the path on which the workpiece or the workpiece to be drawn is drawn through the drawing die, will not vary in its running height or direction with respect to the drawing die when different press-on forces are exerted onto the drawing plane. This allows for constant drawing quality, particularly when the workpieces change, for example, when the material or the wall thickness or the diameter thereof changes. It is understood that such an arrangement is particularly advantageous with adjusting means disposed in the drawing plane or symmetrically with respect to said drawing plane, even independently of the other features of the present invention.

Such type adjusting means can be provided of a particularly simple construction if the adjusting means comprise at least one hydraulic cylinder for adjusting the chain carriers. By means of such type hydraulic cylinders, differences with regards to the press-on geometry can be particularly readily accommodated without further regulating devices having to be provided on the drawing machine. Force differences, which are transferred to the workpiece on the chain carriers when pressing on the tools, can be particularly advantageously accommodated by means of hydraulic cylinders disposed in the drawing plane.

For example, both the first adjusting means and the second adjusting means respectively comprise a series of hydraulic cylinders.

In order to additionally achieve uniform and symmetrical force distribution, it is advantageous if the gantry is also configured to be symmetrical with respect to the drawing plane and/or the press-on plane.

The drawing machine is particularly uncomplicated if the frame and the gantry for holding the adjusting means for chain carriers are identical.

It is understood that such a symmetrical gantry could also be provided in a non-symmetrical frame in order for the adjusting means provided in the drawing plane to be capable of taking and absorbing press-on forces in a particularly favourable manner. Therefore, the features regarding the present gantry are also advantageous, irrespective of the other features.

As an alternative or in addition thereto, the above mentioned object is also solved, irrespective of the other features of the present invention, by a method of drawing a linear workpiece through a drawing die, by which the workpiece to be drawn is conveyed by means of a first and a second tool chain of a caterpillar conveyor, said first tool chain being held by a first chain carrier and said second tool chain being held by a second chain carrier, at least one of the chain carriers being displaceable for applying press-on forces and said first and said second tool chain forming a drawing plane in which the workpiece to be drawn is being moved, said method being characterized in that the press-on forces are applied in the drawing plane.

The press-on forces can be applied above and below a press-on plane containing a drawing path and oriented vertically with respect to the drawing plane so that the drawing path can be readily kept rectilinear with respect to a drawing die.

In this context, the present method for drawing a linear workpiece to be drawn through a drawing die advantageously experiences a further development if, in order to draw the linear workpiece, at least one chain carrier is aligned with respect to the linear workpiece, the at least one chain carrier being retained in the drawing plane by at least one adjusting means and is moved and aligned in the drawing plane with respect to the linear workpiece to be drawn.

The two frame halves are joined together in a particularly simple manner in terms of construction and can advantageously absorb the press-on forces if the two frame halves are joined together by means of connecting means and if the adjusting means are disposed on the connecting means. If the frame is made from a grid construction, the frame halves are advantageously connected by means of a horizontally oriented beam or tube.

In this context, it is advantageous if the connecting means include or form the force splitter. The force splitter allows for a particularly good distribution of the forces flowing through the connecting means onto the two frame halves.

Preferably, a tensile element configured to be symmetrical with respect to the drawing plane, meaning an element, which opposes with tensile forces the pressure forces and/or other forces applied through the chain carriers, is provided between a force splitter for the first chain carrier and a force splitter for the second chain carrier. Likewise, a tensile element configured to be symmetrical with respect to the drawing plane can be provided between a connecting means for the first chain carrier provided between the frame halves and a connecting means for the second chain carrier provided between the frame halves. This already suffices to ensure sufficient frame symmetry, with the tensile element advantageously opposing the press-on forces by applying corresponding tensile forces.

Through the symmetry of the tensile element with respect to the drawing plane, torques in the frame can be outstandingly accommodated, so that unnecessary displacement of the chains or of the chain carriers out of the drawing plane can be avoided.

In order to also particularly advantageously be capable of absorbing drawing forces occurring on the drawing die while drawing a workpiece therethrough, it is advantageous if the drawing die is disposed on the frame with symmetrically configured supporting means. This will allow the drawing die to readily follow the extension of the frame subjected to load.

The symmetry of the supporting means for the drawing die can hereby advantageously be both with respect to the drawing plane and with respect to a plane disposed perpendicular to the drawing plane in the drawing path. In order to particularly effectively counteract tilting of the drawing die subjected to load, both should be provided for.

Preferably, the supporting means include at least one cross-tie with a direction component pointing onto the frame so that the occurring tensile forces can be opposed in a particularly efficient manner, utilizing as little material as possible.

The supporting means can include at least one cross-tie with a component departing from the drawing die and leading toward the frame, away from the drawing path. Then, this support can readily oppose forces diverging from the drawing path or line so that the drawing die can be positioned effectively. Such a self-centering support for the drawing die can be particularly realized with cross-ties configured according to the above symmetry, this allowing optimizing the drawing result, utilizing as little material as possible.

It is understood that the symmetrical support for the drawing die described herein above and the cross-ties described herein above can find application singly or together, even irrespective of the other features of the present invention, for the drawing die of a drawing machine.

Other advantages, goals and properties of the present invention will be discussed in the following description of the drawing enclosed in which a drawing machine of the invention is illustrated by way of example.

Figure 1:
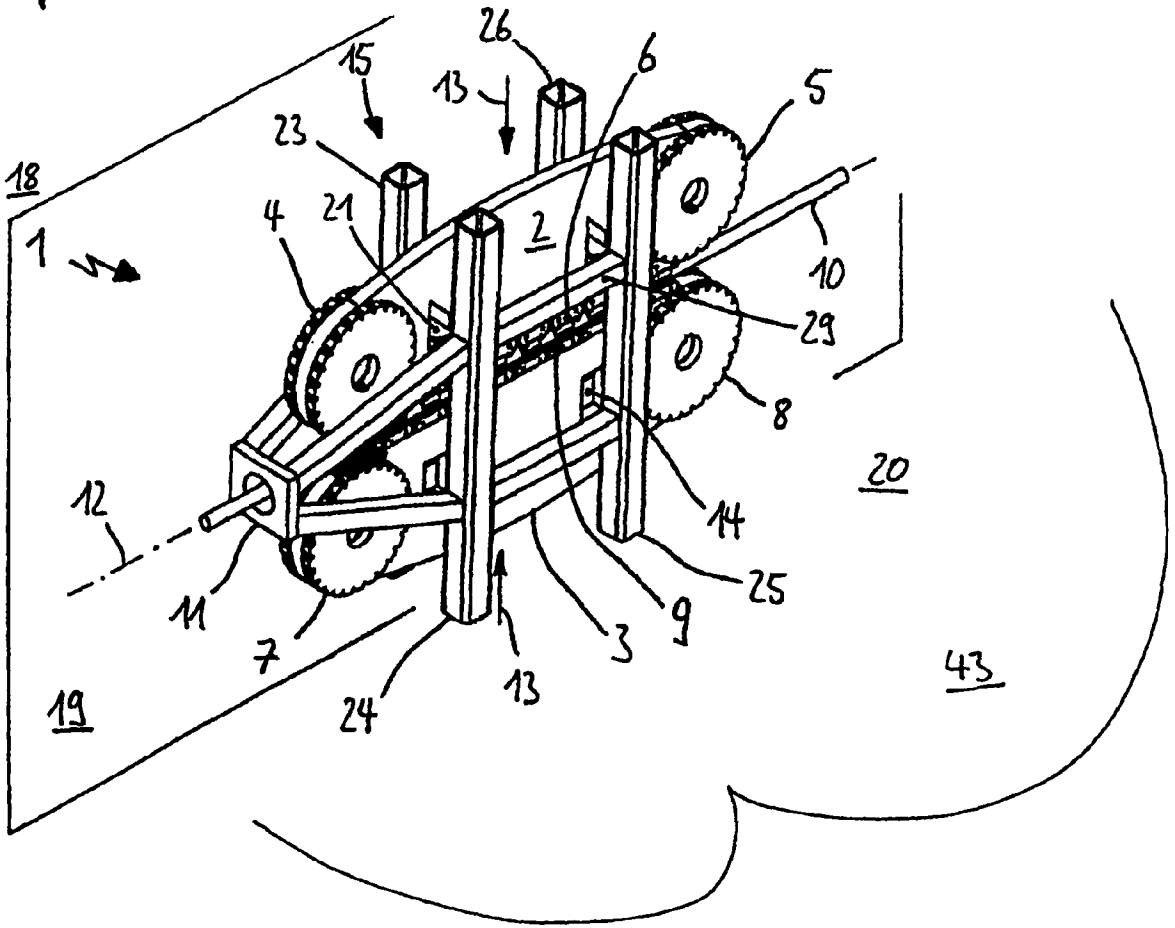
FIG. 1 shows schematically a perspective view of the drawing machine.

The caterpillar conveyor 1 shown in the FIGS. 1 through 4 comprises a first chain carrier 2 and a second chain carrier 3. A first front chain wheel 4 and a first rear chain wheel 5 by means of which a first tool chain 6 is driven are disposed on the first chain carrier 2. Accordingly, a second front chain wheel 7 and a second rear chain wheel 8 by means of which a second tool chain 9 is driven are disposed on the second chain carrier 3. Both chains 6 and 9 are each only shown schematically in the drawing region, although they revolve about the chain carriers 2 and 3. A workpiece 10 to be drawn is pulled through a drawing die 11 along a drawing path 12 by means of the first tool chain 6 and the second tool chain 9.

In order to dispose the two chain carriers 2 and 3 in such a manner with respect to each other that they allow for applying press-on forces 13 onto the workpiece 10, the two chain wheels 2 and 3 are mounted to be travelable with respect to each other in a frame 15 by means of pressure cylinders 14 (labelled with reference numerals by way of example only). In this exemplary embodiment, the frame 15 comprises a first frame half 16 and a second frame half 17, the first frame half 16 being disposed on a first side 18 of a drawing plane 19 and the second frame half 17 on a second side 20 of the drawing plane 19, with the chain carriers 2, 3, the chain wheels 4, 5, 7, 8 and the chains 6, 9 being disposed in the drawing plane 19 (see in particular FIG. 3 and FIG. 4 in this respect). The plane 19 coincides with the main direction of the drawing path 12. The two frame halves 16 and 17 are substantially identical so that the frame 15 generally comprises a symmetrical structure, in particular with respect to the drawing plane 19.

The two frame halves 16 and 17 are joined together by means of cross bars 21 (labelled with reference numerals by way of example only). There are two such cross bars 21 in the region of the first chain carrier 2 and two in the region of the second chain carrier 3. The pressure cylinders 14 by means of which the two chain carriers 2 and 3 are moved with respect to each other are disposed on the cross bars 21. The pressure cylinders 14 are hereby also disposed substantially in the drawing plane 19 so that press-on forces 13 departing from the pressure cylinders 14 are substantially absorbed half from the first frame half 16 and half from the second frame half 17. This allows achieving a very homogeneous load distribution in the entire frame 15 so that the frame 15 can be of a very compact construction on the one side and may be ideally loaded up to its material yield point on the other side.

Due to the symmetrical configuration of the frame 15 and of the cross bars 21 acting as a force splitter, main beams 23, 24, 25 and 26 of the frame 15 are substantially subjected to tensile load 27 and 28 (shown by way of example on the main beams 24 and 25 in FIG. 2) when press-on forces 13 are being applied. Through the symmetrical shape of the frame 15, the frame 15 is allowed to stretch evenly in a tensile region 30 of the main beams 23, 24, 25 and 26 so that the press-on forces 13 will be transmitted very evenly onto the workpiece 10 to be drawn. In the tensile region 30, the main beams 23 through 26 serve as a symmetrical tensile element. In the present exemplary embodiment, the tensile region 30 is located between the cross bars 21 on which there is mounted the first chain carrier 2 and the cross bars 21 on which there is fixed the second chain carrier 3.

Figure 2:
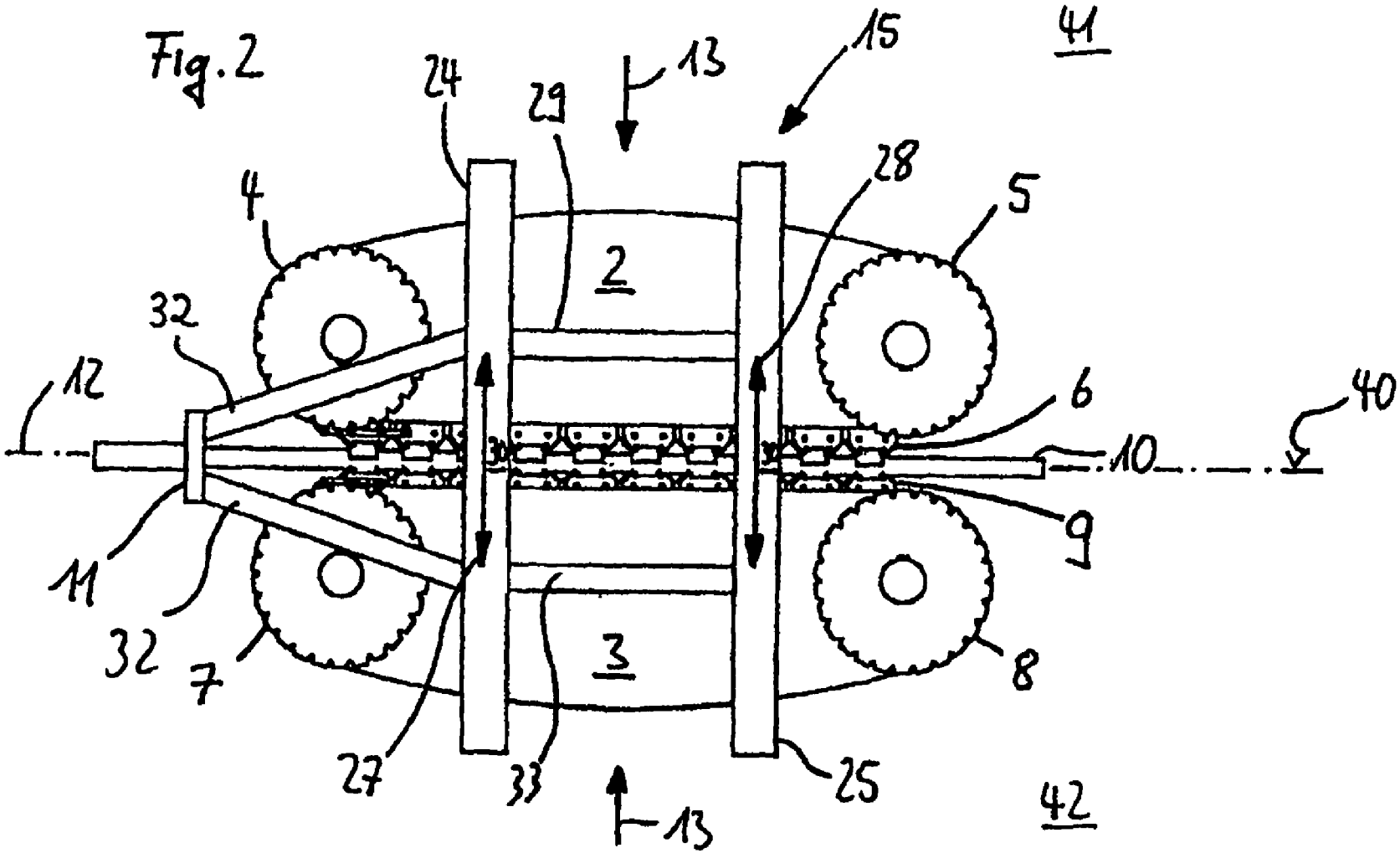
FIG. 2 shows schematically a side view of the drawing machine of FIG. 1.
Figure 3:
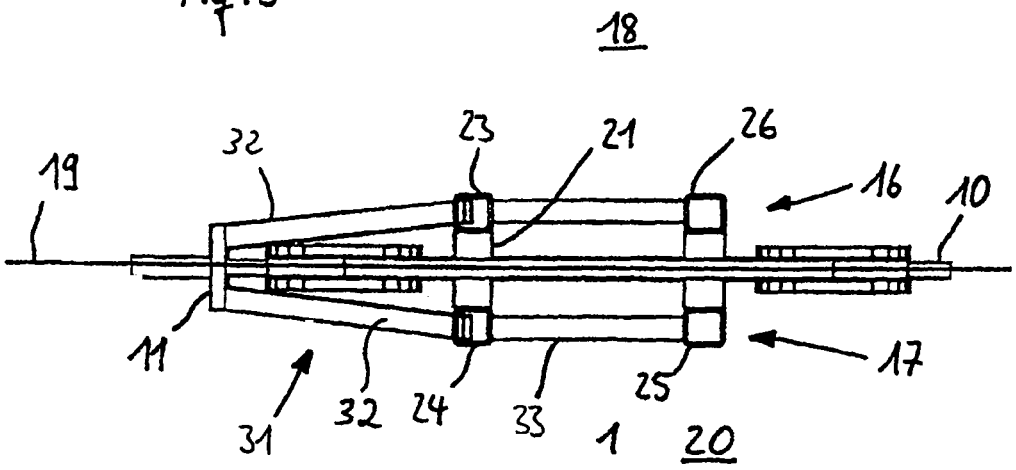
FIG. 3 shows schematically a top view of the drawing machine of the FIGS. 1 and 2 and FIG. 4 shows schematically a front view in the direction of transport of the drawing machine of the FIGS. 1 through 3.
Figure 4:
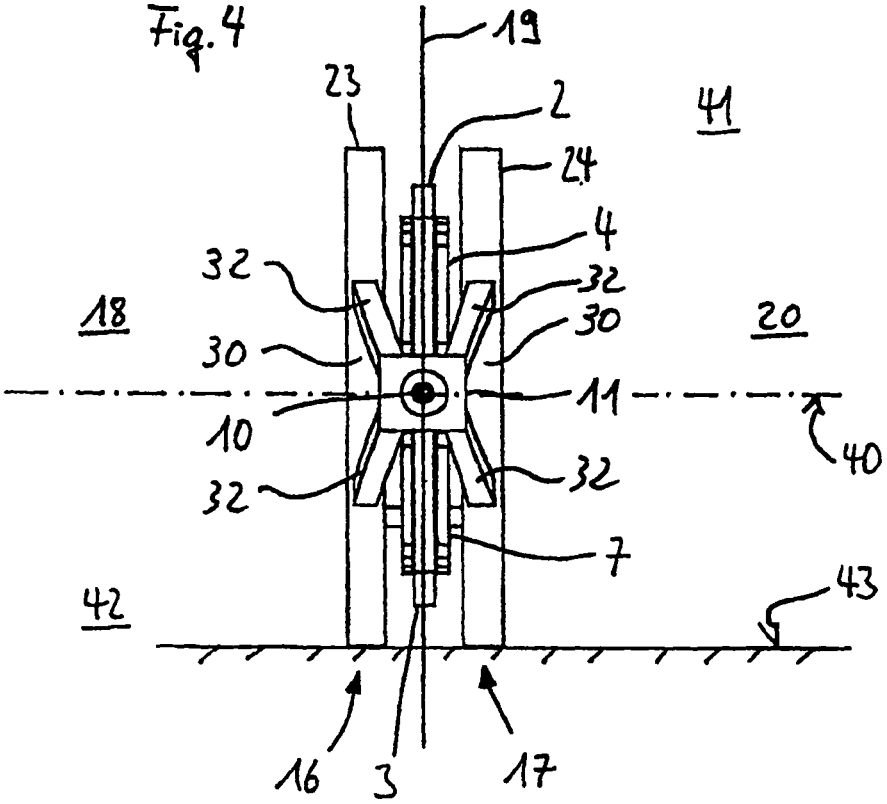

In order to achieve particularly good support for tensile forces acting onto the drawing die 11 and in order for the drawing die 11 to experience, if any, only a relative movement with respect to the caterpillar conveyor 1 that is as symmetrical as possible with respect to the workpiece to be drawn under the action of the drawing forces, the drawing die 11 is advantageously disposed in this exemplary embodiment on the symmetrically formed frame 15 by means of a symmetrically formed supporting device 31 consisting of four supporting bars 32 (labelled with numerals in the FIGS. 2 through 4 by way of example only). The supporting bars 32 are disposed on the level of longitudinal bars 33 (labelled with numerals by way of example only) so that drawing forces will as far as possible be absorbed not only by the main beams 23 and 24 turned toward the drawing die 11 but, at least in parts, also by the main beams 25 and 26 turned away from the drawing die 11. As a result, drawing forces occurring with respect to the drawing die 11 will be absorbed evenly by the two symmetrical frame halves 16 and 17.

The term "tensile forces" is understood to refer herein to such forces that act onto the drawing die 11 when drawing the workpiece 10. The tensile forces act onto the main beams 23 and 24 through the four supporting bars 32 in the form of pressure forces. The pressure forces are hereby directed symmetrically into the frame 15.

As can be seen in FIG. 4, a press-on plane 40 is disposed perpendicular to the plane 19, with the drawing plane 19 and the press-on plane 40 intersecting in the drawing path 12.

In the present case, the frame 15 is not only symmetrical with respect to the drawing plane 19 but also with respect to the press-on plane 40 so that the part of the frame 15 on the first side 41 of the press-on plane is identical with the part of the frame on the second side 42 of the press-on plane.

This symmetry makes it possible for means for neutralizing press-on forces within the present frame 15 to eliminate or at least strongly reduce press-on forces below a critical value so that no or, if any, only insignificantly weak forces will leave the frame 15 and reach other components of the present caterpillar conveyor.

In this exemplary embodiment, the means for absorbing press-on forces substantially consist of the tensile regions 30 of the main beams 23, 24, 25 and 26. Together with the cross bars 21, the means for absorbing press-on forces form a gantry which carries the cylinders 14 acting as adjusting means. As can be seen in the FIGS. 1 through 3, the longitudinal bars 33 substantially have neither a carrying function nor a function of absorbing press-on forces. Insofar, the longitudinal bars 33 can be obviated in this respect with regards to the configuration of the gantry or of the frame of the present invention. On the other side, the longitudinal bars 33 rigidify the gantry or the frame in an advantageous manner, actually also irrespective of possible tensile forces, with the longitudinal bars 33 being responsible for constant or more constant distribution of these drawing forces especially with respect thereto.

It is understood that in other examples of application, the means for neutralizing press-on forces may also be of a more complex construction as long as they are substantially configured to be substantially symmetrical with respect to the drawing plane 19 and/or with respect to the press-on plane 40 so that the first and second press-on forces will substantially neutralize each other. The symmetry of frame or gantry is of particular importance in the region opposing the press-on forces, it being possibly of advantage, on the other side, to configure the entire frame to be substantially symmetrical since this allows for using largely identical components, this contributing to equalize the inner forces.

As can be seen from the FIGS. 1 and 4, the frame is standing on a floor 43.

The invention claimed is:

1. A drawing machine for drawing a linear workpiece (10) through a drawing die, the drawing machine comprising:

a caterpillar conveyor (1) comprising a first chain carrier (2), a second chain carrier (3), a first tool chain (6) and a second tool chain (9), wherein said first chain carrier (2), said second chain carrier (3), said first tool chain (6) and said second tool chain (9) are disposed in and form a drawing plane (19) in which the workpiece to be drawn is caused to move;

a frame (15) supporting said caterpillar conveyor (1), wherein at least one of said first chain carrier (2) and said second chain carrier (3) is displaceable relative to said frame (15) via a pressure cylinder (14) rigidly coupled to said frame (15);

said frame (15) comprising a first frame half (16) disposed on a first side (18) of the drawing plane (19) and a second frame half (17) disposed on a second side (20) of the drawing plane (19), wherein said first frame half (16) is substantially identical to said second frame half (17) such that said frame (15) comprises a substantially symmetrical structure with respect to the drawing plane (19);

said first frame half (16) comprising a first main beam (23) and said second frame half (17) comprising a second main beam (24);

wherein each of said first main beam (23) and said second main beam (24) is subjected to a substantially equal tensile load (27, 28) in a respective tensile region (30) when press-on forces are applied to the workpiece (10), thereby providing for a substantially equal distribution of the press-on forces (13) which are absorbed by the frame (15).

2. The drawing machine as set forth in claim 1, wherein the frame carries the two chain carriers.

3. The drawing machine as set forth in claim 1, wherein the frame is standing on a base or the floor.

4. The drawing machine as set forth in claim 1, wherein first chain wheels for guiding the first tool chain are disposed on the first chain carrier.

5. The drawing machine as set forth in claim 1, wherein second chain wheels for guiding a second tool chain are disposed on the second chain carrier.

6. The drawing machine as set forth in claim 1, comprising means for neutralizing press-on forces within the frame so that first press-on forces, which are applied to a first press-on plane side and second press-on forces, which are applied to a second press-on plane side, are neutralizing each other within said frame.

7. The drawing machine as set forth in claim 1, wherein means for neutralizing press-on forces are configured to be symmetrical with respect to the drawing plane and/or with respect to a press-on plane.

8. The drawing machine as set forth in claim 1, wherein means for neutralizing press-on forces are disposed on both the first frame half and the second frame half.

9. The drawing machine as set forth in claim 1, wherein means for neutralizing press-on forces are disposed in a tensile region of the frame halves.

10. The drawing machine as set forth in claim 1, comprising a force splitter by means of which press-on forces applied for drawing the workpiece are distributed between the frame halves, symmetrically with respect to the drawing plane.

11. The drawing machine as set forth in claim 10, wherein the force splitter traverses the drawing plane.

12. The drawing machine as set forth in claim 1, wherein the caterpillar conveyor comprises a gantry that carries adjusting means for at least one of the two chain carriers, said adjusting means being substantially disposed in the drawing plane.

13. The drawing machine as set forth in claim 1, wherein the caterpillar conveyor comprises a gantry that carries first adjusting means for the first chain carrier and second adjusting means for the second chain carrier, said first and second adjusting means being substantially disposed in the drawing plane.

14. The drawing machine as set forth in the claim 12, wherein the adjusting means comprise at least one hydraulic cylinder for adjusting the chain carriers.

15. The drawing machine as set forth in claim 12, wherein the gantry is configured to be symmetrical with respect to the drawing plane and/or the press-on plane in the region opposing the press-on forces.

16. The drawing machine as set forth in claim 1, wherein the frame and a gantry for holding the adjusting means for chain carriers are identical.

17. The drawing machine as set forth in claim 1, wherein the two frame halves are joined together by means of connecting means.

18. The drawing machine as set forth in claim 17, wherein the connecting means comprise a force splitter.

19. The drawing machine as set forth in claim 1, wherein a tensile element, which is devised to be symmetrical with respect to the drawing plane, is provided between a force splitter and/or a connecting means for the first chain carrier provided between the frame halves and a force splitter and/or a connecting means for the second chain carrier provided between the frame halves.

20. The drawing machine as set forth in claim 1, wherein the drawing die is disposed on the frame with symmetrically formed supporting means so that forces acting onto the drawing die are introduced substantially symmetrically into the two frame halves.

21. The drawing machine as set forth in claim 20, wherein the supporting means include at least one cross-tie having a direction component pointing toward the frame.

22. The drawing machine as set forth in claim 20, wherein the supporting means include at least one cross-tie having a component departing from the drawing die and leading toward the frame, away from the drawing path.

23. A method of drawing a linear workpiece (10) through a drawing die, comprising:

moving the workpiece to be drawn in a drawing plane (19) formed by a first chain carrier (2), a second chain carrier (3), a first tool chain (6) and a second tool chain (9) of a caterpillar conveyor (1), said first chain carrier (2), said second chain carrier (3), said first tool chain (6) and said second tool chain (9) being disposed in the drawing plane (19);

providing a frame (15) supporting said caterpillar conveyor (1), wherein at least one of said first chain carrier (2) and said second chain carrier (3) is displaceable relative to said frame (15) via a pressure cylinder (14) rigidly coupled to said frame (15), said frame (15) comprising a first frame half (16) disposed on a first side (18) of the drawing plane (19) and a second frame half (17) disposed on a second side (20) of the drawing plane (19), wherein said first frame half (16) is substantially identical to said second frame half (17) such that said frame (15) comprises a substantially symmetrical structure with respect to the drawing plane (19), said first frame half (16) comprising a first main beam (23) and said second frame half (17) comprising a second main beam (24);

subjecting each of said first main beam (23) and said second main beam (24) to a substantially equal tensile load (27, 28) in a respective tensile region (30) when press-on forces (13) are applied to the workpiece (10), thereby providing for a substantially equal distribution of the press-on forces (13) which are absorbed by the frame (15).

24. The method as set forth in claim 23, wherein the press-on forces are applied above and below a press-on plane containing a drawing path and oriented vertically with respect to the drawing plane.

25. The method as set forth in claim 23, wherein at least one chain carrier is aligned with respect to the linear workpiece, the at least one chain carrier being retained in the drawing plane by at least one adjusting means, and is moved and aligned in the drawing plane with respect to the linear workpiece to be drawn.

26. The method as set forth in claim 23, wherein a frame or gantry opposes press-on forces needed for drawing the workpiece symmetrically with respect to the drawing plane.

27. The method as set forth in claim 26, wherein the frame or gantry receives press-on forces between the tool chains.

28. The method as set forth in claim 26, wherein the frame carries the two chain carriers.

29. The method as set forth in claim 26, wherein the frame is standing on a base or the floor.

30. A drawing machine for drawing a linear workpiece (10) through a drawing die, the drawing machine comprising:

a caterpillar conveyor (1) comprising a first chain carrier (2), a second chain carrier (3), a first tool chain (6) and a second tool chain (9), wherein said first chain carrier (2), said second chain carrier (3), said first tool chain (6) and said second tool chain (9) are disposed in and form a drawing plane (19) in which the workpiece to be drawn is caused to move;

a frame (15) supporting said caterpillar conveyor (1);

said frame (15) comprising a first frame half (16) disposed on a first side (18) of the drawing plane (19), a second frame half (17) disposed on a second side (20) of the drawing plane (19) and a cross bar (21) joining said first frame half (16) and said second frame half (17), wherein said first frame half (16) is substantially identical to said second frame half (17) such that said frame (15) comprises a substantially symmetrical structure with respect to the drawing plane (19);

a first pressure cylinder and a second pressure cylinder (14) coupled to said frame (15), at least one of said first pressure cylinder and said second pressure cylinder disposed on said cross bar (21), wherein said first pressure cylinder (14) displaces said first chain carrier (2) relative to said frame (15) and said second pressure cylinder displaces said second chain carrier (3) relative to said frame (15);

wherein press-on forces (13) departing from the first and second pressure cylinders (14) are absorbed by said frame (15) in a substantially equally distributed manner with one half of the press-on forces absorbed by the first frame half (16) and one half of the press-on forces absorbed by the second frame half (17).

31. A method for drawing a linear workpiece (10) through a drawing die, comprising:

moving the workpiece to be drawn in a drawing plane (19) formed by a first chain carrier (2), a second chain carrier (3), a first tool chain (6) and a second tool chain (9) of a caterpillar conveyor (1), said first chain carrier (2), said second chain carrier (3), said first tool chain (6) and said second tool chain (9) being disposed in the drawing plane (19);

providing a frame (15) supporting said caterpillar conveyor (1), a first pressure cylinder coupled to said frame (15) and a second pressure cylinder (14) coupled to said frame (15), said frame (15) comprising a first frame half (16) disposed on a first side (18) of the drawing plane (19), a second frame half (17) disposed on a second side (20) of the drawing plane (19) and a cross bar (21) joining said first frame half (16) and said second frame half (17), at least one of said first pressure cylinder and said second pressure cylinder disposed on said cross bar (21), wherein said first frame half (16) is substantially identical to said second frame half (17) such that said frame (15) comprises a substantially symmetrical structure with respect to the drawing plane (19);

displacing said first chain carrier (2) relative to said frame (15) with said first pressure cylinder (14); and displacing said second chain carrier (3) relative to said frame (15) with said second pressure cylinder (14);

absorbing press-on forces (13) departing from said first and second pressure cylinders (14) with said frame (15) in a substantially equally distributed manner with one half of the press-on forces absorbed by said first frame half (16) and one half of the press-on forces absorbed by said second frame half (17).

* * * * *